United States Patent [19]

Quinn et al.

[11] Patent Number: 4,895,275

[45] Date of Patent: Jan. 23, 1990

[54] DISPENSING SPIKE FOR PENETRABLE PRE-FILLED SHAPE RETENTIVE CONTAINERS

[75] Inventors: David G. Quinn, Grayslake; Robert B. Edwards, II, Libertyville; Erik Andersen, Vernon Hills, all of Ill.

[73] Assignee: Corpak, Inc., Wheeling, Ill.

[21] Appl. No.: 238,391

[22] Filed: Aug. 30, 1988

[51] Int. Cl.[4] ..... B67B 7/24

[52] U.S. Cl. ..... 222/81; 222/155; 222/159; 222/478; 604/260; 604/407; 604/411

[58] Field of Search ..... 184/85; 137/123; 222/80–82, 155, 158, 159, 204, 416, 428; 604/407, 408, 411, 246, 260, 128, 129

[56] References Cited

U.S. PATENT DOCUMENTS

| | | | |
|---|---|---|---|
| 2,491,516 | 12/1949 | Piggot et al. | 222/82 |
| 3,001,525 | 9/1961 | Hendricks | 222/80 |
| 3,092,106 | 6/1963 | Butler | 222/159 |
| 4,479,274 | 10/1984 | Biby | 137/123 |
| 4,588,396 | 5/1986 | Stroebel et al. | 604/246 |
| 4,655,763 | 4/1987 | Malcolm et al. | 604/404 |
| 4,699,296 | 10/1987 | Schrock, Jr. | 222/85 |
| 4,787,890 | 11/1988 | Ufermann | 222/204 |

*Primary Examiner*—H. Grant Skaggs

*Attorney, Agent, or Firm*—Wallenstein, Wagner & Hattis, Ltd.

[57] ABSTRACT

A device for dispensing enteral feeding solutions and other therapeutic fluids from penetrable, shape retentive containers comprising a unitary dispensing spike for penetrating a topside panel of such containers which are suspended in an orientation to define an uppermost end and a lowermost end. The dispensing spike of the present invention includes an ambient air vent integrally formed therein. The present invention further includes a fluid visualization chamber which permits a user to determine the volume of fluid within the container.

18 Claims, 2 Drawing Sheets

DISPENSING SPIKE FOR PENETRABLE PRE-FILLED SHAPE RETENTIVE CONTAINERS

DESCRIPTION

TECHNICAL FIELD

The present invention generally relates to the field of enteral nutritional feeding, and, in particular, to an improved device for dispensing of enteral fluids or other therapeutic solutions from a pre-filled and penetrable, shape retentive container.

BACKGROUND ART

Enteral nutrition is achieved through naso-esophageal intubation of a feeding tube. Typically, the enteral feeding tube is connected to a container, such as a flexible bag similar to that disclosed in U.S. Pat. No. 4,529,102.

Recently, shape retentive containers have been successfully utilized in enteral feeding therapy, such as the shape retentive paperboard cartons disclosed in U.S. Pat. No. 4,287,247 and sold under the trademarks TETRA PAK, TETRA BRIK, and BRIK PAK. Such cartons are pre-filled with enteral nutritional fluid and then sealed. However, to administer enteral solutions from such cartons, it is necessary to utilize a device which can aseptically access the fluid contents of the carton without leakage and deliver such fluids at a controlled rate.

One such device is a dual spike fluid dispensing column disclosed in U.S. Pat. No. 4,699,296. However, this fluid dispensing device requires use of a rigid cradle structure to support and suspend the carton in a particular angular orientation in which the carton has a single uppermost corner and a single lowermost corner. This cradle is expensive to manufacture and complicates set up of an enteral feeding administration system. In addition, this fluid dispensing device punctures the container near the bottom of one front panel raising a possibility of fluid leakage from the puncture site.

Another dispensing device is disclosed in U.S. Pat. No. 4,655,763 for a vented tubular dispensing spike which removably receives a pH testing indicator. Unlike the dual spike device in U.S. Pat. No. 4,699,296 which provides visualization of fluid level within the shape retentive container by means of a transparent dispensing column, the tubular dispensing spike disclosed in U.S. Pat. No. 4,655,763 has no means for fluid level visualization. Fluid level visualization is necessary because shape retentive containers, such as BRIK PAK cartons, are non-transparent. As a result the volume of fluid and fluid level in the carton is unknown to a user.

Further, the dispensing spike of U.S. Pat. No. 4,655,763 achieves container venting through a separate vent tube externally secured to the dispensing spike. As a result, a larger opening is created in the container by the dispensing spike thereby increasing the possibility of fluid leakage.

Hence, prior to the present invention, a need existed for a unitary spike for aseptic topside access and dispensing of enteral feeding fluids from a shape retentive, pre-filled container, such as a BRIK PAK carton, in which an ambient air vent means was integrally formed within the spike to minimize the size of the spike opening and avoid leakage. A need further existed for a unitary dispensing spike which provided a "sight chamber" for visualization of fluid volume and level within the container. Finally, a need existed for a unitary dispensing spike which would permit passive delivery of fluids through siphon action or gravity feeding.

SUMMARY OF THE INVENTION

According to the present invention, a device for dispensing enteral feeding solutions and other therapeutic fluids from penetrable, shape retentive containers has been developed which generally embodies a unitary dispensing spike for penetrating a topside panel of such containers which are suspended in an orientation to define an uppermost end and a lowermost end. The dispensing spike of the present invention has an ambient air vent integrally formed therein. As a result the dimensions of the puncture opening in a topside panel of the container is minimized to alleviate leakage at the puncture site. The dispensing spike of the present invention further includes a fluid visualization chamber which permits a user to determine the volume of fluid within the container. The unitary spike of the present invention is constructed to permit passive siphoning as well as active pumping of fluid from the container.

In all embodiments of the present invention the dispensing spike comprises a tubular member having a first arm joined to a second arm in an acute angle. A fluid lumen and, preferably, a venting lumen axially pass through each arm and from one end of the tubular member to the other. The venting lumen vents the shape retentive container to the ambient air through a port positioned at the elbow formed at the union of the first arm with the second arm. At an end of the first arm is a spike tip for penetrating a container while an end of the second arm carries a fluid visualizing means. The fluid visualizing means includes a chamber which is transparent, translucent or has other means for viewing the level of fluid contained in the chamber.

In one embodiment of the present invention the fluid visualization chamber may include either a semi-rigid or a distensible sleeve secured to the second arm. In this embodiment an inlet tube in fluid communication with the fluid lumen, terminates within the chamber and permits accumulation of fluid within the chamber. In another embodiment of the present invention the inlet tube passes completely through the visualization chamber but has an aperture in the side wall of the tube to discharge fluid into the chamber.

Other advantages and aspects of the invention will become apparent upon making reference to the specification, claims, and drawings to follow.

DETAILED DESCRIPTION

Figure 1:
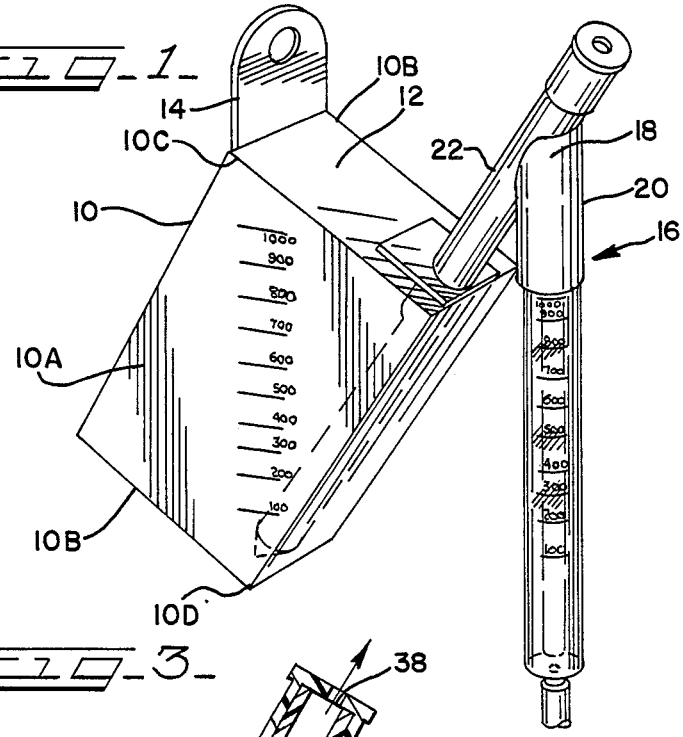
FIG. 1 discloses in a perspective view one embodiment of the present invention.

While this invention is susceptible of embodiment in many different forms, there is shown in the drawings and will be described in detail a preferred embodiment of the invention. The present disclosure is to be considered only as an exemplification of the principles of the invention and is not intended to limit the broad aspect of the invention to embodiment illustrated.

Referring now to the drawings, FIG. 1 discloses a sealed, shape retentive container 10, pre-filled with an enteral feeding solution. Container 10 preferably is of a paperboard-type construction such as the cartons marketed under the trademark BRIK PAK made by Tetra Pak International, Inc. The construction of such cartons permits easy penetration of the carton walls with fluid dispensing spikes, as will be discussed later in greater detail. Container 10 has at least two front walls 10A and, depending on the configuration of the container, a plurality of end panels 10B.

To suspend container 10 in an orientation suitable for administration of enteral fluids, a hanger 12 having a suspending tab 14 may be wrapped around end panels 10B although other container hanger or cradle means known in the art may be used. Hanger 12 suspends container 10 in a manner to define an uppermost end 10C and a lowermost end 10D. The importance of this orientation to the effective administration of enteral feeding solutions will be explained below.

To access the contents of container 10, a tubular dispensing spike of the present invention, generally referenced by 16, may penetrate a topside end panel 10B. As disclosed in FIGS. 1–3, dispensing spike 16 is defined by a tubular member 18 comprised of a first arm 20 angularly joined in an acute angle to a second arm 22.

Arm 22 has a terminal end 24 which carries a point 26 for puncturing and penetrating container 10. Terminal end 24 of arm 20 is generally hollow and carries an axial fluid lumen 28 which is accessible through a fluid inlet opening 30. As disclosed in FIG. 2 the length of arm 20 is selected to coincide with the volumetric size of container 10 so that terminal end 24 is positioned at or near the bottom of the container. Hence, fluid is drawn from the bottom of container 10 and into fluid lumen 28.

A feature of dispensing spike 16 of the present invention is the incorporation of an integral vent within the spike assembly thereby minimizing the outer dimensions of the penetrating end of the spike. Unlike prior art dispensing spikes which utilize venting tubes externally joined to the spike assembly, the integral vent of the present invention reduces the size of the puncture hole in the container with a reduction in fluid leakage around the point of entry of the dispensing spike into the container. Venting of container 10 with filtered ambient air is essential while emptying the container to prevent collapse of the container or stoppage of fluid flow. As disclosed in FIG. 3, a vent lumen 32 is longitudinally axial and parallel with fluid lumen 28. A first vent inlet 34 opens underneath a flange 36 which positions inlet 34 within the pocket of air typically trapped above the fluid in the container. Flange 36 also limits the extent that arm 22 may be inserted into the container and prevents inadvertent submersion of vent inlet 34 into the fluid in container 10. Ambient air is introduced into the container through lumen 32 and inlet 34 by means of port 38 formed at the union of arms 20 and 22. Port 38 is enclosed by a cap 40 which may include a bacteriostatic filter.

Fluid lumen 28 continues from arm 22 and passes through first arm 20 to terminate in a fluid outlet 42 at one end of arm 20. In a preferred embodiment of the present invention, vent lumen 32 continues from arm 22 and passes through arm 20, longitudinally parallel with the fluid lumen 28. Though continuation of vent lumen 32 into arm 20 may not in some embodiments of the present invention be necessary, when lumen 32 does pass through arm 20 it terminates at a vent outlet 44.

The one end of arm 20 preferably terminates in a generally concave well 46 defined by a peripheral wall 48. A fluid opening 42 and the vent outlet 44 empty into well 46. Concentrically positioned within well 46 is a collar 50 which surrounds fluid opening 42. In one embodiment of the present invention a semi-rigid and preferably transparent fluid visualization chamber 52 is interference fit and heat or RF welded or resin bonded to the inner surfaces of wall 48 of well 46. Visualization chamber 52, when embodied as a semi-rigid chamber may be made from PVC or other suitable transparent elastomers. Formed or secured at the bottom of visualization chamber 52 is a coupling 54 having an inner bore 56. Coupling 54 may be joined to a segment of tubing 58 which forms a portion of a fluid administration set.

Figure 3:
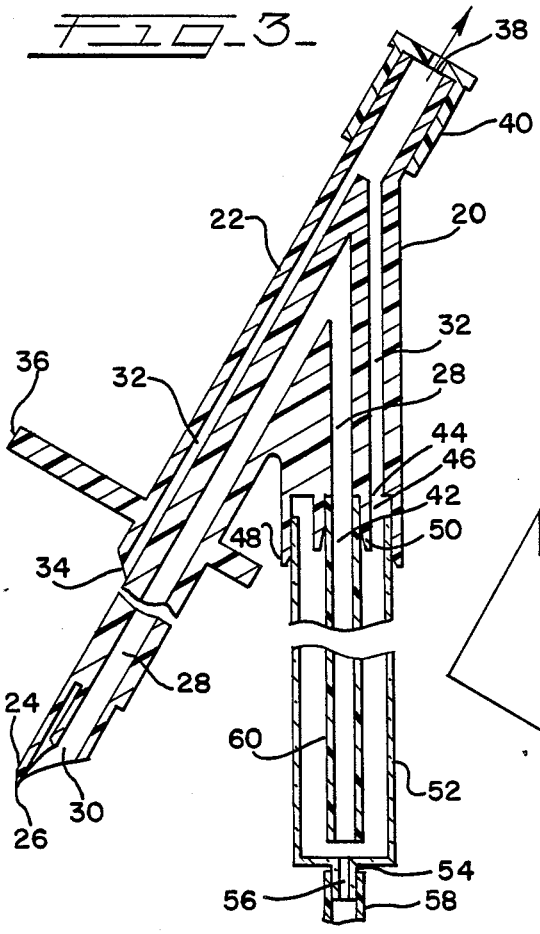
FIG. 3 discloses in vertical section the embodiment of FIG. 1 illustrating a semi-rigid visualization chamber with an inlet tube terminating therein.

FIG. 3 discloses an inlet tube 60 being disposed within visualization chamber 52. Tube 60 is secured within collar 50 and extends essentially the length of chamber 52 terminating near the bottom of chamber 52. In all embodiments of the present invention, it is essential for operability that the inner diameter of inlet tube 60 be larger than the inner diameter of bore 56 of coupling 54. This allows for inflow of fluid into chamber 52 to exceed fluid outflow through bore 56 and therefore an adequate accumulation and of fluid within chamber 52.

Figure 2:
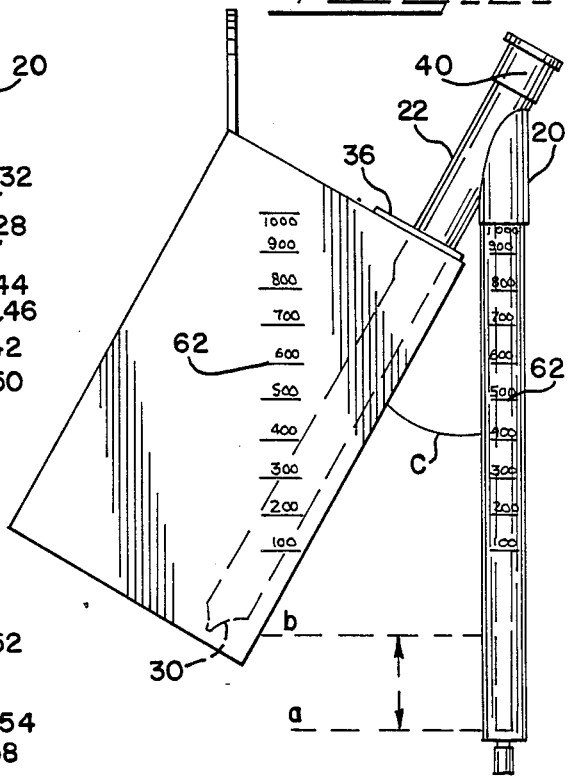
FIG. 2 discloses in side elevation the embodiment of the present invention shown in FIG. 1.

As disclosed in FIG. 2 both container 10 and visualization chamber 52 may be marked with volumetric indicia 62. By use of indicia 62 on chamber 52 a user may determine the actual volume of fluid remaining in the container and then refer to indicia 62 on container 10 to ascertain the approximate level of fluid within the container.

In all embodiments of the present invention, for spike 16 to create a proper siphon action to passively draw fluid out of container 10 a height differential must be established between the outflow of fluid and the inflow of fluid. As shown in FIG. 2 the level of fluid outflow defined by the terminus of tube 60 and indicated as "a" must be at a level lower than the level of fluid intake defined at intake opening 30 and indicated as "b". The distance between level a and level b imparts sufficient weight to the fluid column within tube 60 to maintain a siphon action.

In addition to the above parameters the preferred angle indicated as "c" in FIG. 2 formed between the side wall of container 10 and visualization chamber 52 which results in optimal operation of spike 16 is approximately 30 degrees from vertical.

Figure 4:
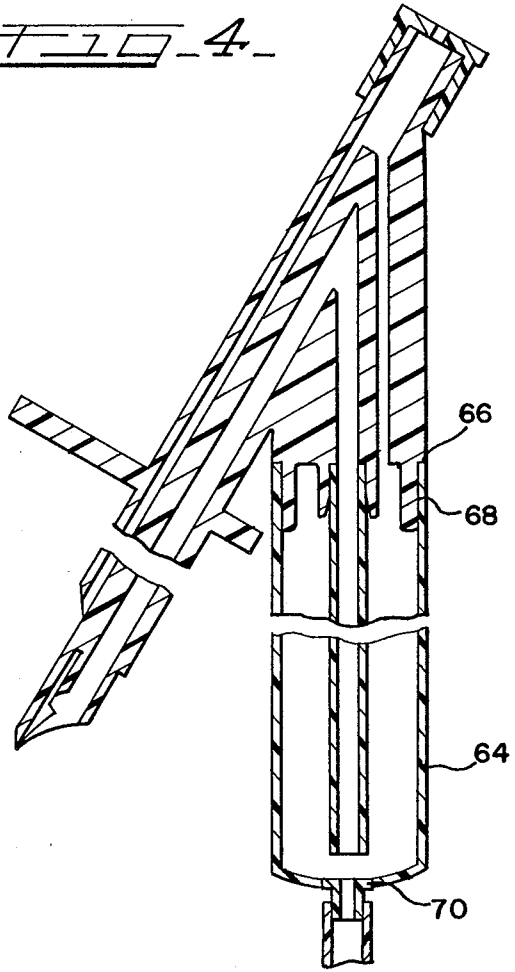
FIG. 4 is the same view as FIG. 3 disclosing another embodiment of the present invention wherein a visualization chamber embodies a distensible sleeve having an inlet tube terminating therein; and, FIG. 5 is a perspective view of another embodiment of the present invention utilizing a visualization chamber embodies a distensible sleeve having an inlet tube passing through the sleeve.

FIG. 4 discloses an alternative embodiment of dispensing spike 16 in which a distensible sleeve 64 functions as a fluid visualization chamber. An upper edge 66 of sleeve 64 is bonded or heat or RF welded to a recessed shoulder 68 in wall 48. In addition an outlet plug 70 is also secured to the bottom of the sleeve to function as a tube coupler.

Figure 5:
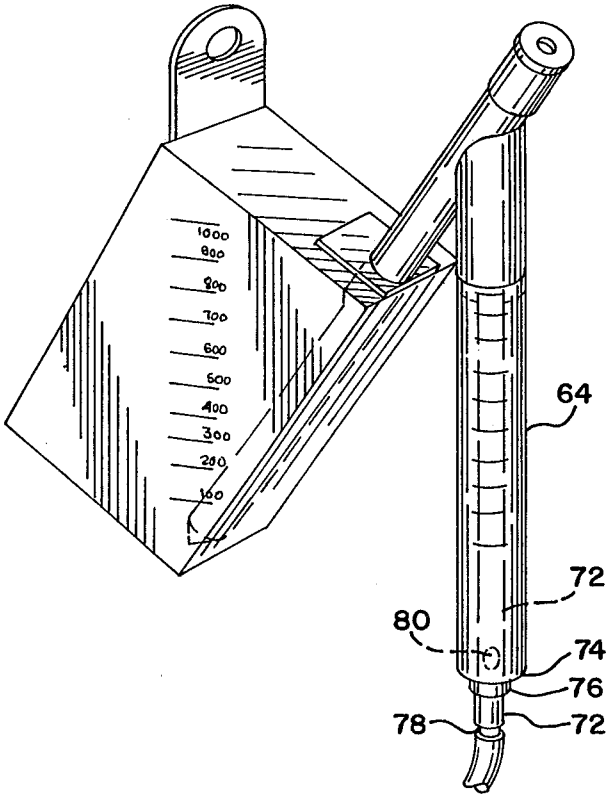

FIG. 5 discloses a further embodiment of spike 16 in which the distensible sleeve 64 surrounds an inlet tube 72 which completely passes through sleeve 64. An upper end of tube 72 seats within collar 50 in the same manner as tube 60 as disclosed in FIGS. 3 and 4. A lower end of tube 72 passes through a bottom 74 of sleeve 64. A collar or other annular member 76 secured to bottom 74 forms a leak-proof seal with tube 72. Upon emerging from sleeve 64, tube 72 is fitted with a coupler 78 which like coupler 56 and 70 in the embodiments disclosed in FIGS. 3 and 4 has an inner bore with an inner diameter smaller than the inner diameter of tube 72 so that fluid inflow into visualization sleeve 72 exceeds fluid outflow. Fluid inflow into visualization sleeve is achieved by means of an aperture 80 in the wall of tube 72. Placement of aperture 80 along tube 72 must be close to the bottom 74 of sleeve 64 to insure the creation of a sufficient height differential for development of proper siphoning action.

In order to utilize spike 16 to dispense fluids from a shape retentive container, a user suspends the container in such a manner to define an uppermost end and a lowermost end. The user then inserts point 26 into a topside end panel located near the uppermost end of the container. The user inserts arm 22 into the container until flange 36 abuts against the topside panel and then connects to the couplers 56, 70, and 78 to tubing from an administration set of the kind known in the art. Next, the user primes the spike 16 by gently squeezing container 10 which upon release of container 10 draws fluid upward into fluid lumen 28. It may be necessary for the user to place a finger over vent port 38 to prevent fluid from expressing up through vent lumen 32 and out of spike 16. After the siphon action has initiated, the fluid visualization chamber will fill with fluid to indicate the volume of fluid in the container. As the container gradually empties the level of fluid in the visualization container lowers accordingly.

While the specific embodiments have been illustrated and described, numerous modifications come to mind without significantly departing from the spirit of the invention and the scope of protection is only limited by the scope of the accompanying claims.

We claim:

1. A device for dispensing therapeutic fluid from a penetrable shape retentive container containing a selected volume of the fluid, the container being suspendable to define an uppermost end and a lowermost end, the device penetrating the uppermost end of the container, comprising:

a tubular member having one arm angularly joined to an other arm, the tubular member having at least a fluid lumen passing through each arm, the fluid lumen having an inlet at one end of the member and an outlet at an other end of the member, the fluid inlet being disposed within the container near the lowermost end, the one arm having means for penetrating the container at the one end of the member, the other arm carrying fluid visualization means at the other end of the member;

the fluid visualization means including a chamber having means for viewing fluid contained therein to determine the volume of fluid in the container, the chamber being juxtaposed to and parallel with the container, the chamber having a height extending from near the uppermost end to below the lowermost end of the container, a fluid outlet being disposed at a bottom of the chamber; and, an inlet tube disposed within the chamber, the tube being in fluid communication with the fluid lumen of the tubular member, the inlet tube having an aperture within the chamber for discharging fluid into the chamber, the aperture being vertically lower than the inlet of the fluid lumen, the inner diameter of the tube being larger than the inner dimensions of the fluid outlet so that fluid inflow into the chamber exceeds fluid outflow through the fluid outlet.

2. The device for dispensing therapeutic fluids from penetrable shape retentive containers described in claim 1 further including:

the tubular member having a venting lumen integrally formed therein, the venting lumen longitudinally parallel with the fluid lumen in the one arm, the venting lumen having an inlet disposed within the container near the uppermost end on the one arm of the member and a port in communication with ambient air positioned near the junction of the one arm with the other arm.

3. The device for dispensing therapeutic fluids from a penetrable shape retentive container described in claim 1 wherein the inlet tube terminates within the chamber.

4. The device for dispensing therapeutic fluids from a penetrable shape retentive container described in claim 3 wherein the aperture of the inlet tube is at the terminus of the tube within the chamber.

5. The device for dispensing therapeutic fluids from a penetrable shape retentive container described in claim 3 wherein the chamber includes a semi-rigid sleeve.

6. The device for dispensing therapeutic fluids from a penetrable shape retentive container described in claim 3 wherein the chamber includes a distensible sleeve.

7. The device for dispensing therapeutic fluids from a penetrable shape retentive container described in claim 1 wherein the inlet tube passes through the chamber.

8. The device for dispensing therapeutic fluids from a penetrable shape retentive container described in claim 7 wherein the aperture of the inlet tube is located in a side wall of the tube near the bottom of the chamber.

9. A device for dispensing therapeutic fluid from a penetrable shape retentive container containing a selected volume of the fluid, the container being suspendable to define an uppermost end and a lowermost end, the device penetrating the uppermost end of the container, comprising:

a tubular member having one arm angularly joined to an other arm, the tubular member having at least a fluid lumen passing through each arm, the fluid lumen having an inlet at one end of the member and an outlet at an other end of the member, the fluid inlet being disposed within the container near the lowermost end;

the tubular member having a venting lumen integrally formed therein, the venting lumen longitudinally parallel with the fluid lumen in the one arm, and longitudinally parallel with the fluid lumen in the other arm of the tubular member, the venting lumen having an inlet disposed within the container near the uppermost end at the one end of the member and a port in communication with ambient air positioned near the junction of the one arm with the other arm;

the one arm having means for penetrating the container at the one end of the member;

the other arm carrying fluid visualization means at the other end of the member, the fluid visualization means including a chamber having means for viewing fluid container therein to determine the volume of fluid in the container, the chamber being juxtaposed to and parallel with the container, the chamber having a height extending from near the uppermost end to below the lowermost end of the container, a fluid outlet being disposed at a bottom of the chamber; and an inlet tube disposed within the chamber, the tube being in fluid communication with the fluid lumen of the tubular member, the inlet tube having an aperture within the chamber for discharging fluid into the chamber, the aperture being vertically lower than the inlet of the fluid lumen, the inner diameter of the tube being larger than the inner dimensions of the fluid outlet so that fluid inflow into the chamber exceeds fluid outflow through the fluid outlet.

10. A device for dispensing therapeutic fluid from a penetrable shape retentive container containing a selected volume of the fluid, the container being suspendable to define an uppermost end and a lowermost end, the device penetrating the uppermost end of the container, comprising:

a tubular member having one arm angularly joined to an other arm, the tubular member having at least a fluid lumen passing through each arm, the fluid lumen having an inlet at one end of the member and an outlet at an other end of the member, the fluid inlet being disposed within the container near the lowermost end, the one arm having means for penetrating the container at the one end of the member, the other arm carrying fluid visualization means at the other end of the member;

the fluid visualization means including a chamber having means for viewing fluid contained therein to determine the volume of fluid in the container, the chamber being juxtaposed to and parallel with the container, the chamber having a height extending from near the uppermost end to below the lowermost end of the container, a fluid outlet being disposed at a bottom of the chamber, an inlet tube having a terminus within the chamber and being in fluid communication with the fluid lumen, the inlet tube having an aperture at the terminus for discharging fluid into the chamber, the aperture being vertically lower than the inlet of the fluid lumen, the inner diameter of the inlet tube being larger than the inner dimensions of the fluid outlet so that fluid inflow into the chamber exceeds fluid outflow through the fluid outlet to permit accumulation and retention of fluid within the chamber.

11. The device for dispensing therapeutic fluids from penetrable shape retentive containers described in claim 10 further including:

the tubular member having a venting lumen integrally formed therein, the venting lumen longitudinally parallel with the fluid lumen in the one arm, the venting lumen having an inlet disposed within the container near the uppermost end on the one arm of the member and a port in communication with ambient air positioned near the junction of the one arm with the other arm.

12. The device for dispensing therapeutic fluids from a penetrable shape retentive container described in claim 10 wherein the chamber includes a semi-rigid sleeve.

13. The device for dispensing therapeutic fluids from a penetrable shape retentive container described in claim 10 wherein the chamber includes a distensible sleeve.

14. A device for dispensing therapeutic fluid from a penetrable shape retentive container containing a selected volume of the fluid, the container being suspendable to define an uppermost end and a lowermost end, the device penetrating the uppermost end of the container, comprising:

a tubular member having one arm angularly joined to an other arm, the tubular member having at least a fluid lumen passing through each arm, the fluid lumen having an inlet at one end of the member and an outlet at an other end of the member, the fluid inlet being disposed within the container near the lowermost end;

the tubular member having a venting lumen integrally formed therein, the venting lumen longitudinally parallel with the fluid lumen in the one arm, and longitudinally parallel with the fluid lumen in the other arm of the tubular member, the venting lumen having an inlet disposed within the container near the uppermost end at the one end of the member and a port in communication with ambient air positioned near the junction of the one arm with the other arm;

the one arm having means for penetrating the container at the one end of the member;

the other arm carrying fluid visualization means at the other end of the member, the fluid visualization means including a chamber having means for viewing fluid contained therein to determine the volume of fluid in the container, the chamber being juxtaposed to and parallel with the container, the chamber having a height extending from near the uppermost end to below the lowermost end of the container, a fluid outlet being disposed at a bottom of the chamber; and an inlet tube having a terminus within the chamber and being in fluid communication with the fluid lumen, the inlet tube having an aperture at the terminus for discharging fluid into the chamber, the aperture being vertically lower than the inlet of the fluid lumen, the inner diameter of the inlet tube being larger than the inner dimensions of the fluid outlet so that fluid inflow into the chamber exceeds fluid outflow through the fluid outlet to permit accumulation and retention of fluid within the chamber.

15. A device for dispensing therapeutic fluid from a penetrable shape retentive container containing a selected volume of the fluid, the container being suspendable to define an uppermost end and a lowermost end, the device penetrating the uppermost end of the container, comprising:

a tubular member having one arm angularly joined to an other arm, the tubular member having at least a fluid lumen passing through each arm, the fluid lumen having an inlet at one end of the member and an outlet at an other end of the member, the fluid inlet being disposed within the container near the lowermost end, the one arm having means for penetrating the container at the one end of the member, the other arm carrying fluid visualization means at the other end of the member;

the fluid visualization means including a chamber having means for viewing fluid contained therein to determine the volume of fluid in the container, the chamber being juxtaposed to and parallel with the container, the chamber having a height extending from near the uppermost end to below the lowermost end of the container;

a tube passing through the chamber, the tube being in fluid communication with the fluid lumen, the tube having an aperture in a side wall and near the bottom of the chamber for discharging fluid into the chamber, the aperture being vertically lower than the inlet of the fluid lumen, the tube being distally connected to an outlet outside of the chamber, the outlet having a smaller inner diameter than the tube so that fluid inflow into the chamber exceeds fluid outflow into the outlet to permit accumulation and retention of fluid within the chamber.

16. The device for dispensing therapeutic fluids from penetrable shape retentive containers described in claim 15 further including:

the tubular member having a venting lumen integrally formed therein, the venting lumen longitudinally parallel with the fluid lumen in the one arm, the venting lumen having an inlet disposed within the container near the uppermost end on the one arm of the member and a port in communication with ambient air positioned near the junction of the one arm with the other arm.

17. The device for dispensing therapeutic fluids from a penetrable shape retentive container described in claim 15 wherein the chamber includes a distensible sleeve.

18. A device for dispensing therapeutic fluid from a penetrable shape retentive container containing a selected volume of the fluid, the container being suspendable to define an uppermost end and a lowermost end, the device penetrating the uppermost end of the container, comprising:

a tubular member having one arm angularly joined to an other arm, the tubular member having at least a fluid lumen passing through each arm, the fluid lumen having an inlet at one end of the member and an outlet at an other end of the member, the fluid inlet being disposed within the container near the lowermost end;

the tubular member having a venting lumen integrally formed therein, the venting lumen longitudinally parallel with the fluid lumen in the one arm, and longitudinally parallel with the fluid lumen in the other arm of the tubular member, the venting lumen having an inlet disposed within the container near the uppermost end at the one end of the member and a port in communication with ambient air positioned near the junction of the one arm with the other arm, the one arm having means for penetrating the container at the one end of the member;

the other arm carrying fluid visualization means at the other end of the member, the fluid visualization means including a chamber having means for viewing fluid contained therein to determine the volume of fluid in the container, the chamber being juxtaposed to and parallel with the container, the chamber having a height extending from near the uppermost end to below the lowermost end of the container; and a tube passing through the chamber, the tube being in fluid communication with the fluid lumen, the tube having an aperture in a side wall and near the bottom of the chamber for discharging fluid into the chamber, the aperture being vertically lower than the inlet of the fluid lumen, the tube being distally connected to an outlet outside of the chamber, the outlet having a smaller inner diameter than the tube so that fluid inflow into the chamber exceeds fluid outflow into the outlet to permit accumulation and retention of fluid within the chamber.

* * * * *